United States Patent [19]

Gilley

[11] 4,017,268

[45] Apr. 12, 1977

[54] HYDROCARBON FUEL CONTAINING DISPERSED HYDROGEN AND METHOD OF USE THEREOF

[76] Inventor: E. Gene Gilley, 1506 Mulberry Road, Martinsville, Va. 24112

[22] Filed: Feb. 12, 1975

[21] Appl. No.: 549,144

[52] U.S. Cl. ..... 44/52

[51] Int. Cl.[2] ..... C10L 1/10

[58] Field of Search ..... 123/DIG. 12; 44/52

[56] References Cited

UNITED STATES PATENTS

| | | | |
|---|---|---|---|
| 1,112,188 | 9/1914 | Atwood | 123/DIG. 12 |
| 1,379,077 | 5/1921 | Blumenberg, Jr. | 123/DIG. 12 |
| 2,110,503 | 3/1938 | Duckham | 44/52 |
| 2,029,748 | 2/1936 | Weber | 44/52 |
| 2,140,254 | 12/1938 | Zavka | 44/52 |
| 3,906,913 | 9/1975 | Rupe | 123/DIG. 12 |
| 3,939,806 | 2/1976 | Bradley | 123/DIG. 12 |

OTHER PUBLICATIONS 1,112,188 09001914 Atwood 123 DIG. 12

Greese et al., "Chemical Technology of Petroleum" 3rd Ed. (1960) pp. 191–194.

*Primary Examiner*—Allen B. Curtis

*Attorney, Agent, or Firm*—Stevens, Davis, Miller & Mosher

[57] ABSTRACT

A liquid hydrocarbon fuel is provided with encapsulated hydrogen gas to increase the amount of energy produced and to reduce the amount of obnoxious combustion products such as carbon monoxide and nitrous oxide when the fuel is burned.

7 Claims, No Drawings

HYDROCARBON FUEL CONTAINING DISPERSED HYDROGEN AND METHOD OF USE THEREOF

This invention relates generally to hydrocarbon fuels and more particularly to a method of increasing the energy developed and of reducing the volume of obnoxious combustion products produced when the fuel burns and to the resulting fuel.

Liquid hydrocarbon fuels such as gasoline, bunker oils, diesel oils, kerosene, hydrocarbon distillates and the like are burned to develop energy which is used to move vehicles such as automobiles and airplanes or as heat in industrial processes or in the space heating of homes, offices or the like. When such fuels are burned in the presence of oxygen undesirable obnoxious combustion products are produced and released to the atmosphere. These undesirable products include carbon monoxide and nitrous oxide which contaminate the environment. The effect of such combustion products on the environment has become of major concern and various efforts have been made to reduce or eliminate the production of such products when fuels are burned. Various types of complicated and expensive catalytic converters have been proposed, for example, for the exhaust systems of automobiles. However, in spite of all these proposals, the environment is still suffering every day from the continued release of large volumes of obnoxious gases into the atmosphere.

It is therefore an object of this invention to provide a method for modifying the burning of a liquid hydrocarbon fuel to reduce or substantially eliminate obnoxious combustion products and to increase the energy produced. Another object of the invention is to provide a simple but effective method of increasing the energy derived from the burning of a hydrocarbon fuel while simultaneously decreasing the amount of undesirable by-products produced. Still another object of the invention is to provide an improved liquid hydrocarbon fuel for vehicles or heating units.

The foregoing objects and others are accomplished in accordance with this invention, generally speaking, by providing a process wherein gaseous hydrogen is dispersed or encapsulated in a liquid hydrocarbon fuel by injecting a pulsating stream of gaseous hydrogen into the liquid hydrocarbon fuel prior to its ignition. The gaseous hydrogen must be substantially uniformly dispersed as bubbles in the fuel at the time it is ignited. In order that the gaseous hydrogen will become encapsulated and remain in the fuel until it is ignited the specific gravity of the fuel should be at least about 0.75. This is the approximate specific gravity of diesel fuel and those fuels such as gasoline having a specific gravity below 0.75 should be mixed with a combustible liquid which will increase the specific gravity of the fuel to at least about 0.75 before the hydrogen is injected therein. A liquid hydrocarbon having a specific gravity of more than 0.75 such as mineral oil or the like may be mixed with the gasoline or other low specific gravity fuel to produce a liquid fuel of the required specific gravity.

Any volume of gaseous hydrogen correctly dispersed in the liquid hydrocarbon fuel will increase the energy developed and reduce the obnoxious products produced when the fuel is burned. However, best results are obtained when the fuel contains from about 10 to about 60% by volume hydrogen so a volume within this range is preferred. The volume of additive such as mineral oil required to adjust the specific gravity of gasoline or the like to at least about 0.75 will, of course, vary with the specific gravity of the fuel and with the specific gravity of the additive and can be determined by one skilled in the art. As pointed out above, most diesel fuels can be used without adjustment of the specific gravity but the specific gravity of kerosene, gasoline and the like is sufficiently low to require adjustment. In some instances, one or more fuels may be mixed together such as diesel oil and gasoline to obtain a fuel of the desired specific gravity but it is preferred to add a combustible additive having a higher specific gravity than that of a diesel fuel to gasoline to avoid excessive dilution of the gasoline.

Any suitable apparatus may be used for injecting a pulsating stream of hydrogen into the liquid hydrocarbon fuel to produce a fuel having gaseous hydrogen encapsulated therein. A solenoid operated piston pump may be used, for example, in conjunction with a tank of liquid hydrogen under pressure. Other suitable pulsating pumps are commercially available and can be used. The fuel becomes charged with gaseous hydrogen bubbles and should be burned substantially immediately in order to avoid the loss of hydrogen. In a vehicle having an internal combustion engine, the hydrogen may be injected into a stream of fuel coming from the fuel tank just before it enters the carburetor. An auxiliary tank of liquid hydrogen under pressure may be provided for use in a fuel burner or furnace and the hydrogen injected into the fuel just before it is ignited. If the fuel is gasoline or other fuel having a specific gravity of less than 0.75 the specific gravity can be adjusted by adding the required amount of mineral oil or other combustible liquid in the fuel tank or a stream of the additive may be injected into the fuel before or simultaneously with the injection of the hydrogen.

Pure hydrogen has six times the burning rate of gasoline. Hydrogen alone will burn but it alone does not have enough combustible materials to provide the power required by an internal combustion engine or to provide the necessary BTU for heating purposes. A fuel which contains about 40% by volume encapsulated hydrogen will produce about four times the energy produced by an equivalent volume of the same fuel which has not had hydrogen added thereto. Stated in another way, the volume of fuel containing about 40% encapsulated gaseous hydrogen required to produce a given amount of energy is about one-fourth the volume required of the same fuel without hydrogen encapsulated therein. Hence, a vehicle operating on a fuel containing about 40% encapsulated hydrogen will travel about four times as far on a gallon of fuel as it would be able to with the same fuel without hydrogen. Moreover, the combustion products released into the atomsphere contain very little, if any, carbon monoxide and nitrous oxide. The invention, thus not only provides a more effective fuel but also provides a fuel which is more attractive to the environmentalist.

As an example of the type of fuel contemplated by the invention, a regular type gasoline having an octane rating of about 90 and a specific gravity adjusted to 0.75 with mineral oil has about 40% by volume hydrogen injected therein by a pulsating pump just before a stream of the gasoline is introduced into the carburetor. This fuel is immediately mixed with air in the proper proportions and charged to the internal combustion engine. It is not necessary to provide catalytic converters or other expensive and complicated types of exhaust equipment to remove carbon monoxide and nitrous oxide from the combustion products. A diesel fuel or kerosene may be similarly provided with encapsulated hydrogen and used in other vehicles or for heating purposes.

While the invention contemplates the use of pure hydrogen wherever possible, it is to be understood that hydrogen mixed with other combustible gases may be used if it is desired to dilute the stream of hydrogen injected into the combustible fluid. This invention has been described in connection with gasoline, oils and similar hydrocarbon fuels but it is to be understood that for the purposes of this invention, other fuels containing hydrogen and carbon with other non-interfering groups such as hydroxyl groups may be used.

Although the invention has been described in detail for the purposes of illustration, it is to be understood that such detail is solely for that purpose and that variations can be made therein by those skilled in the art without departing from the spirit and scope of the invention except as it may be limited by the claims.

I claim:

1. A method for increasing the energy developed when a hydrocarbon fuel is burned and simultaneously reducing the carbon monoxide and nitrous oxide in the combustion products which comprises mixing a hydrocarbon having a specific gravity below 0.75 with a hydrocarbon having a specific gravity above 0.75 to produce a combustible liquid fuel having a specific gravity of at least about 0.75, and dispersing gaseous hydrogen substantially uniformly in the liquid fuel by a process which comprises injecting a pulsating stream of hydrogen into the liquid fuel and igniting the fuel while the hydrogen is still dispersed therein.

2. The method of claim 1 wherein the liquid fuel is gasoline mixed with mineral oil and the mixture has a viscosity of at least about 0.75.

3. A liquid hydrocarbon fuel comprising a mixture of a liquid hydrocarbon fuel having a specific gravity below 0.75 with a liquid hydrocarbon having a specific gravity above 0.75 and having bubbles of gaseous hydrogen dispersed therein, the resulting mixed fuel having a specific gravity of at least about 0.75.

4. The fuel of claim 3 wherein the liquid hydrocarbon fuel having a specific gravity below 0.75 is gasoline.

5. A method of reducing air pollution by an internal combustion engine which burns a hydrocarbon fuel which comprises mixing a hydrocarbon fuel having a specific gravity below 0.75 with a hydrocarbon having a specific gravity above 0.75 to produce a mixture having a specific gravity of at least about 0.75;

dispersing hydrogen substantially uniformly in the resulting mixture; and flowing the resulting dispersion mixed with air into an internal combustion engine where it is ignited.

6. The method of claim 5 wherein the hydrocarbon fuel is gasoline and the hydrocarbon having a specific gravity of above 0.75 is a diesel oil or mineral oil.

7. The method of claim 5 wherein from 10 to 60% by volume hydrogen is injected into the fuel.

* * * * *